US007726418B2

(12) United States Patent
Ayling

(10) Patent No.: US 7,726,418 B2
(45) Date of Patent: Jun. 1, 2010

(54) METHOD AND APPARATUS FOR ADDING A TUBULAR TO DRILL STRING WITH DIVERTER

(75) Inventor: Laurence John Ayling, Camberley (GB)

(73) Assignee: Coupler Development Limited, Douglass, Isle of Man ( * ) Notice: Subject to any disclaimer, the term of this patent is extended or adjusted under 35 U.S.C. 154(b) by 0 days.

(21) Appl. No.: 10/576,893

(22) PCT Filed: Aug. 16, 2004

(86) PCT No.: PCT/GB2004/003501

§ 371 (c)(1),
(2), (4) Date: Apr. 24, 2006

(87) PCT Pub. No.: WO2005/019596

PCT Pub. Date: Mar. 3, 2005

(65) Prior Publication Data

US 2006/0254822 A1 Nov. 16, 2006

(30) Foreign Application Priority Data

Aug. 16, 2003 (GB) ..... 0319317.4

(51) Int. Cl.
*E21B 21/10* (2006.01)

(52) U.S. Cl. ..... 175/241; 175/317; 175/318; 166/316; 166/373; 137/515; 137/605

(58) Field of Classification Search ..... 166/374, 166/373, 319, 332.6, 332.8, 332.3, 334.4, 166/321, 316; 175/241–243, 317, 318, 38, 175/57, 218; 137/515, 515.7, 517, 521, 527, 137/605, 607

See application file for complete search history.

(56) References Cited

U.S. PATENT DOCUMENTS

| | | | | | |
|---|---|---|---|---|---|
| 1,491,986 | A * | 4/1924 | Greene | 137/605 |
| 2,158,356 | A | 5/1939 | Dyer | 255/28 |
| 2,202,192 | A * | 5/1940 | Cypher | 166/72 |
| 2,224,657 | A | 12/1940 | Rodgers | 166/16 |
| 2,239,586 | A * | 4/1941 | Appleby | 175/317 |
| 3,123,157 | A * | 3/1964 | Graham | 175/58 |
| 3,298,385 | A | 1/1967 | Jackson et al. | 137/112 |
| 3,684,318 | A | 8/1972 | Eckert et al. | 285/189 |
| 4,448,267 | A | 5/1984 | Crawford et al. | 175/218 |
| 4,478,244 | A * | 10/1984 | Garrett | 137/515 |
| 4,566,494 | A | 1/1986 | Roche | 137/872 |
| 5,159,981 | A * | 11/1992 | Le | 166/325 |
| 6,230,824 | B1 | 5/2001 | Peterman et al. | 175/214 |
| 7,219,722 | B2 * | 5/2007 | Fincher et al. | 166/65.1 |
| 2006/0037784 | A1 * | 2/2006 | Walter et al. | 175/71 |

FOREIGN PATENT DOCUMENTS

WO WO 03/025334 3/2003

* cited by examiner

*Primary Examiner*—Kenneth Thompson
(74) *Attorney, Agent, or Firm*—Ronald B. Sherer; Gerow D. Brill

(57) ABSTRACT

Apparatus and a method for adding and removing tubulars whilst containing the pressure within a drill string and/or maintaining circulation of drilling fluid down a drill string using a diverter sub which is able to open up to mud flow from a side mud port and close off the flow of mud from above the drill string with or without continuous rotation of the drill string.

14 Claims, 12 Drawing Sheets

METHOD AND APPARATUS FOR ADDING A TUBULAR TO DRILL STRING WITH DIVERTER

The present invention relates to a method for drilling in which tubulars can be added or removed from a drill string whilst the mud is circulating and to apparatus which enables this to be carried out.

It is well known in the drilling industry, and particularly in the field of drilling for oil, natural gas and other hydrocarbons, that drill strings comprise a large plurality of tubular sections, hereinafter referred to as "tubulars", which are connected by male threads on the pins and female threads in the boxes. It is also well known that such tubulars must be added to the drill string, one-by-one, or in "stands" of 2 or 3 connected tubulars, as the string carrying the drill bit drills into the ground, a mile or more below ground being common in the oil drilling art. For various reasons during the drilling, and after the borehole has been drilled, it is necessary to withdraw the drill string, in whole or in part. Again, each tubular or stand must be unscrewed, one-by-one, as the drill string is brought up to the extent required.

With prior art systems, each time that a tubular is added or removed, it is necessary to stop the drilling process and the circulation of drilling fluid. This presents a costly delay in the overall drilling operation. This is because the circulation of drilling fluids is extremely critical to maintaining a steady down hole pressure and a steady and near constant Equivalent Circulating Density (ECD), as is well known in the drilling art. Also, as is well known, when tripping the drill string into or out of the well, the lack of continuous circulation of a drilling fluid causes pressure changes in the well which increases the probability of "kicks".

In addition to the drilling operation, the placement of casings in the bore hole is also necessary. As in the case of tubulars, the placement of casing sections in the prior art presents the same fundamental problems. That is, the flow of drilling fluids must be halted, and the drill string must be withdrawn in its entirety before the casing can be run into the well, which in some instances requires circulation of fluids and rotation of the casing.

In order to overcome these problems, apparatus and methods have been devised to add or remove tubulars with continuous circulation of the drilling mud.

Patent Application PCT/GB97/02815 describes a method for drilling wells in which a drill bit is rotated at the end of a drill string comprising tubular members joined together and mud is circulated through the tubular drill string, in which method tubular members are added to or removed from the drill string whilst the circulation of mud continues.

The method provides for supplying mud at the appropriate pressure in the immediate vicinity of the tubular connection that is about to be broken, within a pressure chamber or 'coupler', as described in detail below; such that the flow of mud provided overlaps with the flow of mud from the top drive. As the tubular separates from the drill string, the flow of mud to the separated tubular is stopped, e.g. by the action of a closing device such as a gate valve.

The separated tubular can then be flushed out, e.g. with air or water (if under water), depressured, withdrawn, disconnected from the top drive and removed. The action of the blind ram is to divide the coupler into two parts, e.g. by dividing the pressure chamber of the coupler connecting the tubular to the drill string. The drill string continues to be circulated with mud at the required pressure from an annulus connection below the blind ram.

In a preferred embodiment of the invention a tubular can be added using a clamping means which comprises a snubber, and the top end of the drill string is enclosed in and gripped by the lower section of the coupler, in which coupler there is a blind ram which separates the upper and lower sections of the coupler. The tubular is then added to the upper section of the coupler and is sealed by pipe rams and the blind rams are opened and the lower end of the tubular and upper end of the drill string are joined together.

In use, the lower section of the coupler below the blind rams will already enclose the upper end of the drill string before the tubular is lowered and when the tubular is lowered into the coupler the upper section of the coupler above the blind rams will enclose the lower end of the tubular.

To contain the drilling fluid, the lower section of the coupler is attached to the top of the suspended drill string, with the blind rams in the closed position preventing escape of circulating drilling fluid. The tubular is lowered from substantially vertically above into the upper section of the coupler and is then sealed in by a seal so that all the drilling fluid is contained within the coupler. The blind rams are then opened and the tubular and the suspended drill string are brought into contact and joined together with the grips bringing the tubular and drill string to the correct torque.

The lower end of the tubular and the upper end of the drill string are separated by the blind rams such that the tubular can be sealed in by upper pipe rams so that, when the blind rams are opened, there is substantially no escape of drilling fluid and the tubular and drill string can then be brought together and made up to the required torque.

To remove another tubular from the drill string, the extension/saver sub under the top drive penetrates the upper part of the pressure chamber, is flushed out with mud and pressured up; the blind rams open allowing the top drive to provide circulating fluid and the extension/saver sub to connect to and to torque up into the drill string. The pressure vessel can then be depressured, flushed with air (or water if under water) and the drill string raised until the next join, or tool joint, is within the pressure chamber, the 'slips and grips' ram closed, the pressure chamber charged with drilling fluid and pressured up and the cycle is then repeated.

Preferably the coupler includes rotating slips which support the drill string while the top drive is raised up to accept and connect another tubular.

In patent application PCT/GB/03411 the upper grips and slips are able to pass through the blind rams when the blind rams are in the open position.

Patent Application PCT/GB01/04803 discloses a coupler and a method for continuously circulating a drilling fluid through a drill string, while adding or removing tubulars has a lower fluid pressure seal adapted to engage a drill string, lower grips adapted to engage a drill string, a valve positioned above said lower grips, upper grips adapted to engage a tubular to be added to or removed from said string and an upper fluid pressure seal adapted to engage said tubular. Patent Application PCT/GB02/003031 discloses a slips assembly which comprises a plurality of slip segments which, when positioned adjacent to each other, form a collar, which collar is larger than the diameter of the tubular body of the tubular at the top of the drill string and smaller than the diameter at the upset shoulder of the said tubular, there being a segment moving means which can move the segments together to form a collar slidably located around the body of the said tubular, which slips assemblies can also be utilised in conjunction with, or as part of, the couplers referred to in prior patent applications, either to support, raise or lower the string below, or restrain, lower or raise the tubular, or stand of tubulars above.

These methods require the disconnection to be carried out under high pressure and therefore require an element of snubbing to bring the pin and box together. The necessary pressure vessel enclosing the entire tool joint under pressure is in two chambers when separated, resulting in a relatively tall and heavy assembly (of 2 or 3 ram or rotary preventers plus a snubber). This is an operation which cannot be combined with conventional making and breaking of tool joints in the open by roustabouts using tongs or iron roughnecks.

The present invention relates to a connector (hereinafter called a diverter sub) which can be attached to or incorporated in a tubular or tubular string or drill string, which enables tubulars to be added to a drill string whilst there is continuous circulation of mud through the drill string and/or continuous rotation of the drill string.

According to the invention there is provided a diverter sub with an inlet and outlet each of which is able to be connected to a drill pipe so as to form a continuous conduit down which mud can be pumped axially, there being a side mud port through which mud can be pumped and a diverter valve mounted within the diverter sub, which diverter valve, in its open position, closes the side mud port and allows mud to be pumped from the inlet down axially through the diverter sub and through the outlet down the drill pipe and which, in its closed position, closes the inlet and opens the side mud port so that mud can be pumped through the side mud port down through the outlet down the drill pipe. Preferably there is a sealing means around the side mud port.

The invention also provides a diverter sub for use in drilling wells comprising (i) connecting means enabling the diverter sub to be connected between two drill pipes so that, in use, mud can be pumped axially down through the diverter sub and down the drill pipe, (ii) a side mud port through which mud can be pumped, (iii) a diverter valve mounted within the diverter sub and (iv) a sealing means which seals around the side mud port and in which diverter sub the diverter valve, in its open position, closes the side mud port and allows mud to be pumped axially down through the diverter sub and in its closed position closes the diverter sub inlet and opens the side mud port so that mud can be pumped through the side mud port down through the drill pipe.

The invention further provides a method for continuously circulating mud and/or continuously rotating the drill string whilst adding a tubular to a drill string, which method comprises having a diverter sub mounted on the top of the drill string, which diverter sub has a side mud port and a diverting valve means which, in the open position, opens the diverter sub and closes the side mud port and in the closed position opens the side mud port and closes the diverter sub, in which method the diverting valve means is switched to the closed position, mud is circulated through the side mud port and down the drill string, a tubular is connected to the top of the diverter sub and the diverting valve means switched to its open position and mud is circulated axially through the added tubular and diverter sub and down through the drill string.

To remove a tubular the process is reversed.

In the prior art methods of adding or removing tubulars with circulation of the mud it has been necessary to surround the pin and box with a high pressure enclosure. The present invention enables the tubulars to be added or removed without the enclosure.

The invention further provides a method of adding or removing a tubular to a drill string with continuous circulation of drilling mud and/or continuous rotation of the drill string in which the end of the tubulars which are to be connected or disconnected are not enclosed in a chamber as they come apart or are connected and/or without having to snub the tubular towards the drill string to achieve closure and/or without having to have any gears or grips or mechanical parts operating in drilling fluids such as mud and/or having to use special thread lubricants to avoid wash off in the turbulent mud flow.

The invention further provides a method of adding or removing tubulars to a drill string in which there is continuous circulation of drilling mud without the need for an enclosure around the end of the tubulars which are to be added or removed, without snubbing against mud pressure, without immersing mechanisms in the mud and without using special thread lubricants.

The addition or removal of the tubulars can be carried out without increasing the height required within the drilling rig.

Continuous circulation and rotation are possible with this invention, e.g. using the rotary 90° grips in combination with diverter subs, with valves actuated as described herein, installed in the drill string, plus 2 or 3 near standard RBOPs to seal to the exterior of the diverter sub and drill string.

By the "open position" is meant that, when the diverter sub is connected between two tubulars, there is a continuous axial channel between the tubulars and mud can be pumped from one tubular through the diverter sub to the other tubular and in the closed position there is no continuous axial channel from one tubular to the other. Thus the diverter sub has the ability to close off the axial flow of mud flowing downwards from the tubular above or the axial flow of mud flowing upwards to the tubular above.

The sealing means seals against the exterior of the diverter sub, around or above and below the said mud port and thereby applies drilling fluid pressure to the exterior of the mud port.

The diverter sub can be installed in the drill string with a tool joint connection above and below it, such that the diverter sub includes a box above it and a pin below it, or it can be integrated into the top of a drill pipe joint so that it forms part of the drill pipe tool joint box upset.

In use the diverting valve means opens the mud port in the side of the diverter sub and closes the axial flow from above, which valve means can be passively operated as with non return valves, with or without springs, or actively operated by a mechanical, hydraulic or electrical means.

Preferably the internal bore of the diverter sub is the same internal diameter as that of the drill pipe, in order to allow free passage of wire-line tools. However, some minimal narrowing of the internal bore may be convenient to accommodate conventional ball, plug, flapper, or non return valve or valves, within the body of the diverter sub, while leaving adequate strength in the diverter sub body.

In practice the diverter sub can be added to the top of a joint or stand of drill pipe and mud can be supplied at full mud pump pressure via the tubular above or the side mud port to contribute part or all of the circulation of mud down the drill string.

In operation preferably the opening of the mud port also allows mud to flow in from the mud port to mix with the mud flowing down the drill string from the tubular above and, as the diverting valve means closes, it cuts off the flow of mud from the tubular above allowing the mud flow down the drill string to emanate substantially from the mud port.

The diverting valve means can be a ball, plug or other state-of-the-art valve that maximises the straight-through diameter, preferably to that of the drill string internal diameter, when open to the axial flow.

The invention also provides a valve which can be used with the diverter sub. The valve comprises a first inlet and a second inlet and an outlet in which a valve in a first position opens the first inlet and closes the second inlet and, in a second position closes the first inlet and opens the second inlet. Preferably when the valve switches from the first position to the second position for at least part of the said switch, both the first and second inlet are open so flow of fluid from the first and second inlet overlap.

Alternatively the valve comprises a shaped surface pivotally mounted in the conduit having a passageway formed, therein the inlet end of said passageway being aligned with the first inlet when the valve is in the first position and aligned with the second inlet when in the second position and in which, in the first and second position, the outlet of said passageway is aligned with the conduit.

Preferably the curved surface forms the pivotally or axially mounted blade of the valve and the said surface is formed substantially entirely from a section of cylinder, which ensures that, in the open position, this valve blade takes up the minimum possible wall thickness.

Preferably the shape of the sealing surface of the blade in the closed position, approximates to sections of two ellipses which, when the valve is closed, seal against a ledge cut into the internal wall of the conduit.

In operation, the flows from the first inlet and the second inlet overlap as the valve blade moves between the first and second positions. The valve may be assisted in its final closing and/or opening by the addition of a spring or springs.

When used with an oil drilling string the seals, which can be any state of the art sealing surface, such as metal to metal, chevron seal or 'o' ring, should be capable of withstanding a pressure differential of up to 5,000 psi or more.

When used with the diverter sub the valve is located within the diverter sub and can switch from the diverter sub inlet to the side mud inlet with the outlet being aligned with the diverter sub outlet which connects to the drill string.

This valve enables full bore axial flow with wall thicknesses that would be inadequate to accommodate a ball valve, by shaping the valve blade, when open, to conform to a section of the cylindrical wall of the diverter sub and yet have a sealing edge, when closed, that matches a sealing surface cut into the internal cylindrical wall of the diverter sub, the valve blade moving through some 30° to 90° between open and closed positions depending on the design of actuation.

The sealing edge, when closed, preferably matches a sealing surface cut into the internal cylindrical wall of the diverter sub, up to its hinge, which consists of a slice of ball valve, requiring no more wall thickness than the thickness of the valve blade, with the valve blade and ball valve slice moving through significantly less than 90° between open and closed positions.

The actuation of the valve can ensure positive completion of opening or closure, where the valve blade is mechanically moved between open and closed positions by a mechanism that allows the actuation to take place while the string is still rotating, thus allowing for continuous circulation and rotation of the drill string, while disconnecting tool joints above or within the new device.

The actuation can be by a mechanical, hydraulic or electrical mechanism and can be a rotational, reciprocating or translation motion.

When tubulars are to be added or removed with continuous circulation of the drill string, the actuation of the valve should ensure positive completion of opening or closure, where the valve blade is mechanically moved between open and closed positions by a new mechanism that allows the actuation to take place while the string is still rotating, thus allowing for continuous circulation and rotation of the drill string, while disconnecting tool joints above or within the new device.

The operation of the diverting valve means can be carried out without external mechanical actuation but by the pressures of the two mud sources, such that, once the mud pressure outside the mud port is raised to that of the said tubular, only a small drop in the tubular pressure or a small increase in the mud port external pressure will open the mud port and cause mud to flow in through the mud port, and with a further decrease in the pressure of the mud in the tubular, the flow of mud will be entirely from the mud port; the reversal of flow between the diverter sub and the tubular above will cause the diverter sub to shut off this axial flow to the tubular above.

This switching of flows from the tubular above to the mud port can be effected by the related or independent action of two non return valves, one allowing flow downwards from the tubular above and the other allowing flow inwards through the mud port.

Manual override of the diverter sub mechanism is available in the event that the diverter sub does not respond adequately to the differential pressures and complete a satisfactory closure of either the mud port flow or the axial flow.

Preferably the diverter valve mechanism within the diverter sub can be securely 'locked' in the open position to avoid accidental opening of the side mud port when the diverter sub is within the well bore. The valve actuator mechanism can both close and open the diverter valve and, by a wedging action, effectively lock the valve in the open position when it is in the open position.

The sealing means preferably applies mud pressure to the exterior of the mud port by sealing around the mud port or circumferentially around the diverter sub above and below the mud port, and the sealing means is capable of containing mud at full mud pump discharge pressure, typically of up to 5,000 psi or more.

The sealing can be a standard or near standard pipe ram preventer, or a rotary preventer, with a double seal, sealing to the diverter sub, above and below the mud port, such that mud can be introduced into the preventer and enter the mud port between the seals irrespective of the azimuth orientation of the mud port.

Alternatively the sealing device can be a standard or near standard pipe ram preventer, or rotary preventer with a standard or near standard single seal, sealing to the diverter sub, above the mud port, coupled with a second pipe ram preventer or rotary preventer sealing below the mud port, either to the diverter sub, or to the tool joint box at the top of the next tubular in the drill string below it, or to the body of the next tubular in the drill string below it, thus enclosing the space around the mud port, in which high pressure mud can be supplied to the mud port.

In another embodiment the sealing means can be a clamp that clamps around the diverter sub and applies a high pressure seal to the area immediately around or above and below the mud port, the said clamp being either in one assembly, through which the drill string passes, or split so that it may be withdrawn substantially from the drillstring without having to disconnect the drill string.

Optionally there can be a mechanical shaft, integrated with the device, to actuate the diverter sub mechanism, either as a normal procedure or as an override, if required, such shaft being capable of manual or machine actuation or the mechanical shaft can be replaced by a hydraulic duct plus a plug, socket or seal to apply hydraulic pressure to the diverter sub to effect the mechanical motion required.

Preferably the diverter sub is not only connected and torqued up to the joint of drill pipe below but it is locked in place so that it cannot inadvertently disconnect when the connection above it is being disconnected.

A drill string can be assembled with tubulars incorporating a diverter sub of the present invention, e.g. by integrating the diverter sub into the structure of the drill pipe joint, such that there is no tool joint between the diverter sub and the joint below but the tool joint box of the drill pipe is elongated to accommodate the diverter sub's structure, mechanism and function, between the threaded section of the tool joint box and the shoulder of the upset between the said tool joint box and the body of the drill pipe joint, thus shortening the length of the overall tool joint upset including the diverter sub.

In an embodiment of the invention, the diverter sub can be capable of stopping circulation by shutting off both the axial flow and the flow from the mud port, at the same time, thereby enabling the drill string to be disconnected at any accessible tool joint, with the drill string beneath remaining closed, such as may be necessary when disconnecting a drill string in an emergency disconnects above a subsea completion in 'riser-less drilling'.

Preferably the diverter sub including its diverter valve is a simple, low cost and highly reliable assembly that can be included in the drill string every 30, 60 or 90 ft or so to facilitate continuous circulation and/or continuous pressure containment and/or continuous rotation.

Accordingly such a mechanism can consist of a blade, being a section of the cylindrical wall of the diverter sub, being rotated about its pivot by some 45 degrees by a mechanical link to a cylindrical collar around the outside of the diverter sub. Thereby a differential rotation of the collar in a clockwise direction relative to the diverter sub can close or open the diverter valve; this effectively locks the valve open since the rotation of the drill string and therefore the diverter sub, in the well bore, is invariably clockwise. This actuation may be carried out while the drill string is continuously rotated since the gripping of the cylindrical collar may be achieved with an RBOP applying a nominal grip and torque provided the RBOP is modified to be motorised and the said drive relates to the rotation of the drill string via a differential gear box that can apply a moderate torque between the diverter sub and the cylindrical collar.

Alternatively, to close or open the diverter valve, hydraulic cylinders may be located in the wall of the diverter sub, with the hydraulic pressure being provided on one side of the pistons by the high pressure mud on the outside of the side mud port and the pressure on the other side of the pistons being at atmospheric pressure when the diverter sub is out of the bore hole. Hence the ports to the hydraulic cylinders can be at different levels in the wall of the diverter sub such that the high pressure is provided by high pressure mud and the low pressure is atmospheric pressure. The closing of the diverter valve is only possible if one of the ports is at low pressure and the opening can be assisted by springs so the valve cannot close when in the well bore.

The method of the invention can be used to break and make tool joint connections without interrupting the circulation of mud while applying conventional or new methods to grip the tubular above and the drill string below it and spin the tubular in or out and torque up or untorque the tool joint connection on all types of tubulars and tubular assemblies, without having to snub a tubular into a high pressure space in order to effect a connection or disconnection or make any special provision for the lubrication of the threads, which might be washed off if connected in flowing mud under pressure.

As well as mud, the invention can be used with any fluid introduced down the drill string during the drilling and completion of a well, including but not limited to drilling mud, foam, cement, chemicals, completion fluid, hydrocarbons and water.

The invention can be used with all manner of tubulars and tubular assemblies, including but not limited to drill pipe, casing, liners, tubing, production tubing, macaroni, coiled tubing and tubular assemblies, including but not limited to bit assemblies, bottom hole assemblies, MWD assemblies and production assemblies.

When used subsea, for example on a seabed located drilling rig, the diverter sub may be applied to eliminate the addition of seawater to the drill string in each new stand of drill pipe, or mud into the sea in each stand withdrawn from the well bore; the diverter sub may include a second port to flush out the tubular above of seawater before adding to the string or mud when removing the stand from the string, or a second diverter sub may be connected or integrated with the lower end of each tubular or stand of tubulars being added to or removed from the drill string.

The diverter sub of the present invention can be used to replace the need for installing flapper valves, non return valves or check valves in the drill string and enable the bottom hole assembly to be extracted completely through a pair of pipe ram or rotating preventers, while maintaining wellhead pressure above or below ambient as may be operationally expedient.

In use the diverter sub can be pre-connected to the top of each joint or stand of drill pipe. The drill string is supported in slips in the centre of the drill floor; the sealing device seals around the diverter sub mud port so that, when the diverter sub flow is diverted, the Top Drive or drill pipe above can be disconnected without interrupting the flow of mud down the drill string.

The tool joint connections can be made conventionally above the diverter sub and sealing device, with or without an iron roughneck. The diverter sub increases the height of a stand of drill pipe by less than about 2 ft. and the sealing device is small enough to be accommodated on most rig floors. The height of the diverter sub, e.g. of some 2 ft, fits in easily above the rotary table.

It is a feature of the invention that it enables there to be continuous circulation of drilling fluids while a tool joint in the drill string is disconnected, without enclosing the said tool joint in a pressure vessel. Additionally the invention does not require snubbing and the equipment is short enough in height to allow conventional tool joint connections to be made above it, with or without the assistance of an iron roughneck and it is small enough to fit on most drilling rigs.

The invention is illustrated in the accompanying drawings in which.

Figure 1:
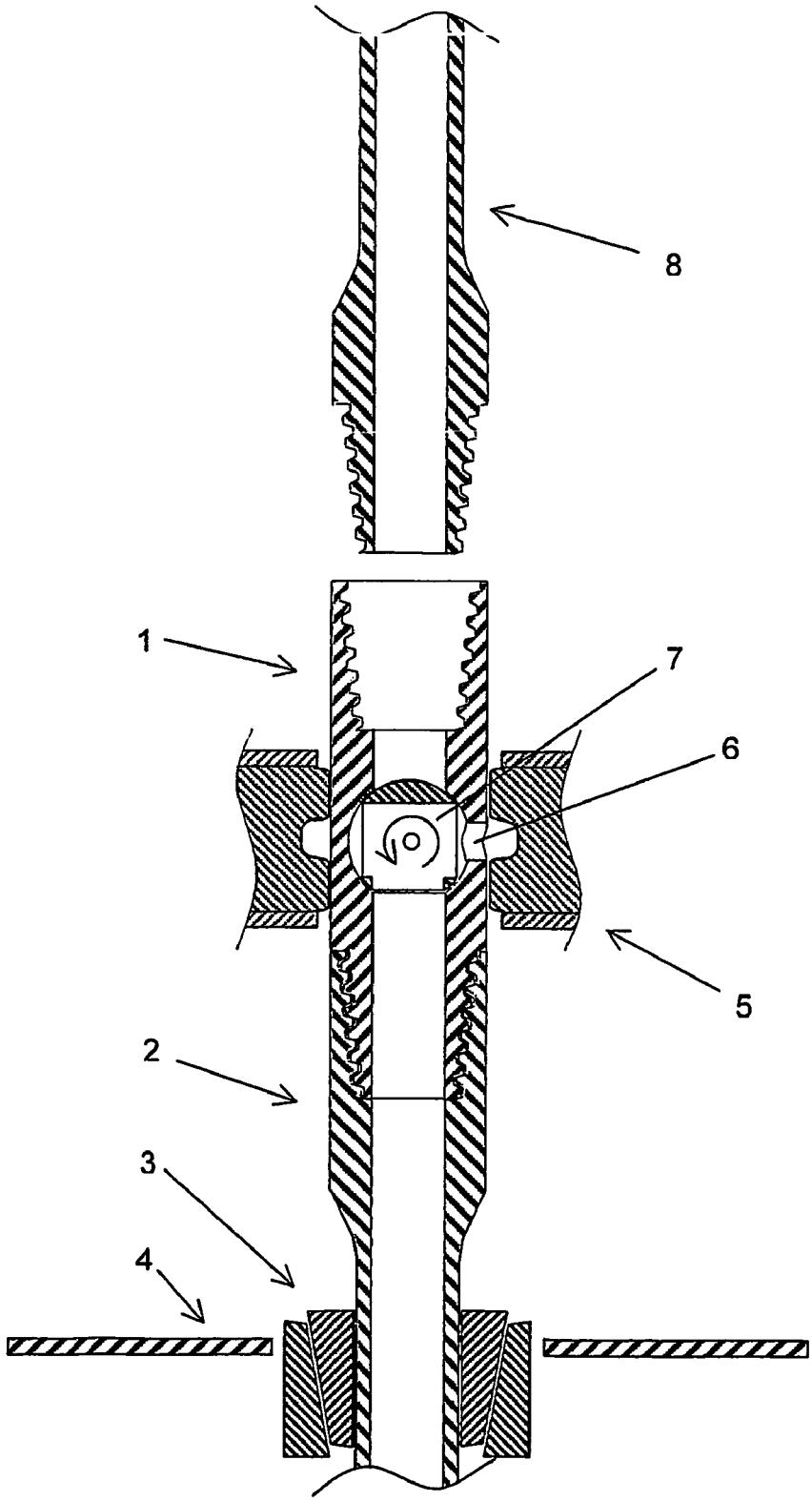
FIG. 1 shows a cross section elevation of the diverter sub in use with the tool joint disconnected.

Referring to FIG. 1, the diverter sub (1) is pre-connected to the top of each joint or stand of drill pipe. In use, the drill string (2) is supported in the slips (3) in the centre of the drill floor (4); a sealing device (5) seals around the diverter sub mud port (6), so that, when the diverter sub flow is diverted (7), the Top Drive or drill pipe (8) above can be disconnected without interrupting the flow of mud down the drill string. The tool joint connections can be made conventionally at (9), above the diverter sub and sealing device, with or without an iron roughneck. The diverter sub (1) increases the height of a stand of drill pipe by less than about 2 ft. and the sealing device (5) is small enough to be accommodated on most rig floors.

Figure 2:
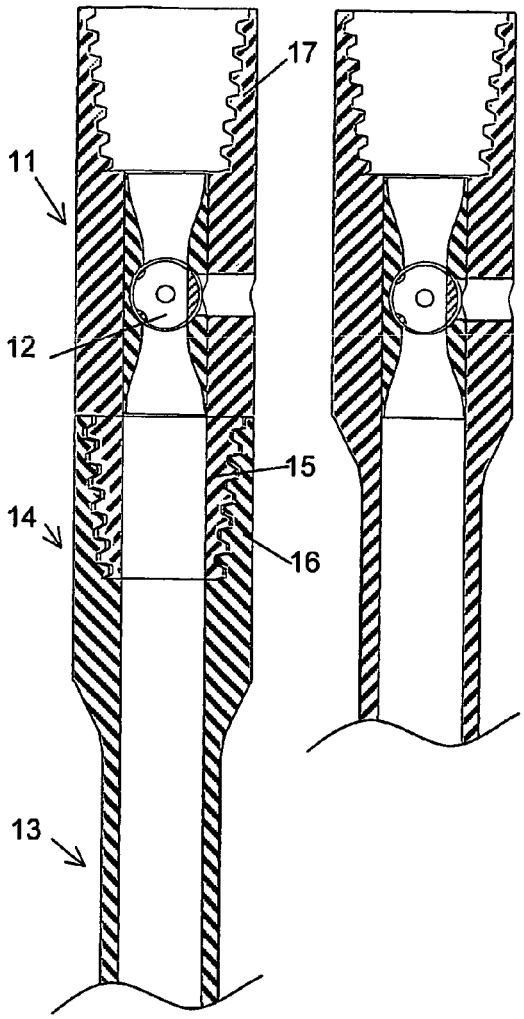
FIG. 2 shows a diverter sub with ball valve insert, connected to the top of a drill pipe and an alternative way of integrating the diverter sub into the tool joint box of the drill pipe.

Referring to FIG. 2, the diverter sub (11) can be fabricated as a 'stand alone' device that contains a valve unit such as a ball valve unit as shown (12) and is pre-connected to the top of a drill pipe (13) at the tool joint (14), with the pin (15) of the diverter sub screwed into and torqued up to the box (16) of the drill pipe tool joint. This connection is to be locked in place by any one of a number of prior art methods so that the connection is not broken inadvertently when the diverter sub box (17) is to be disconnected from the pin of the tubular above. FIG. 2 also shows a more compact version, wherein the diverter sub is integrated with the tool joint box of the drill pipe joint below. In the unusual event that the pins in the drill string were facing upwards, the diverter sub can be assembled with the pin and box reversed.

Figure 3:
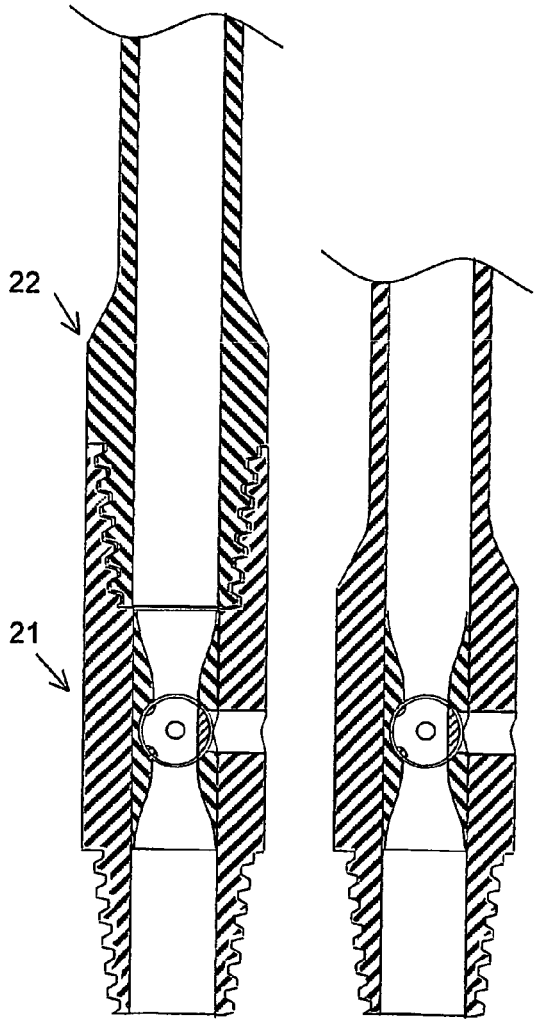
FIG. 3 shows the diverter sub in use as a diverter on the bottom end of a drill pipe, not for continuous circulation but to allow the joint or stand of tubulars above to be drained or flushed out through the mud port as may be required on a seabed rig and/or with certain valuable or harmful drilling fluids.

Referring to FIG. 3, the diverter sub (21) can also be used to divert the flow at the base of the tubular (22) above, not to achieve continuous circulation but to facilitate draining the mud from the tubular before disconnecting it from the drill string and removing it to storage or to prime the tubular with mud before connecting it to the drill string. In subsea use, as on a seabed located drilling rig, this capability ensures that the escape of mud into the surrounding seawater and/or the introduction of seawater into the mud is minimised. FIG. 3 also shows a more compact version, wherein the diverter sub is integrated with the tool joint pin of the drill pipe joint above.

Figure 4:
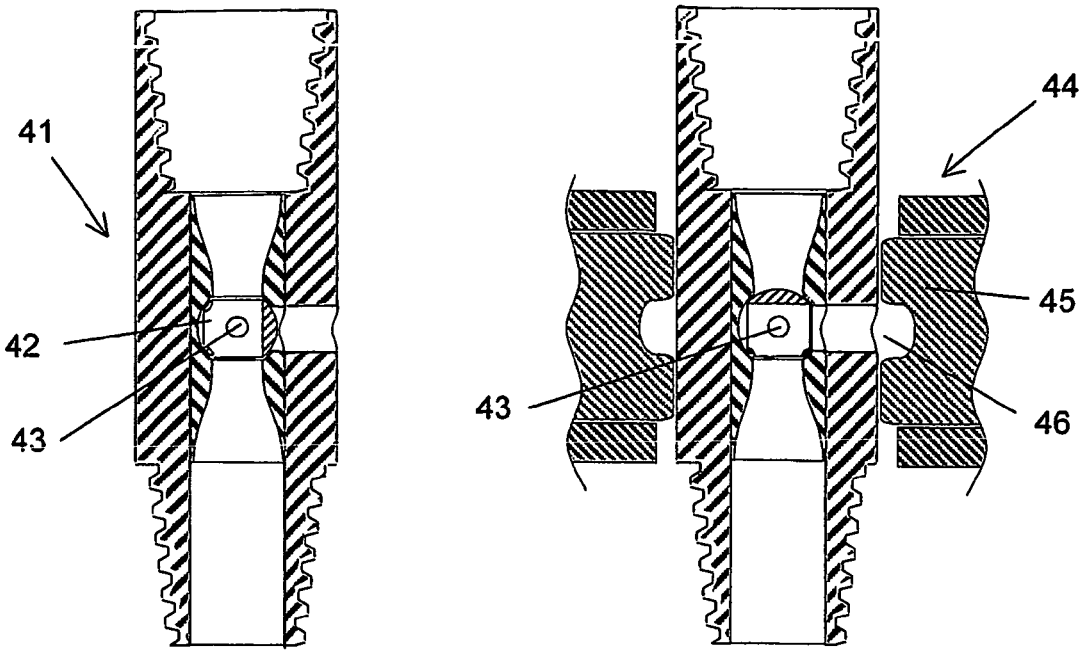
FIG. 4 illustrates the actuation of a conventional ball valve requiring lateral shaft access.

Referring to FIG. 4, the actuation of the diverter sub valve may be by external mechanical or hydraulic means. The ball valve (42) shown is most easily actuated by inserting a shaft into the socket (43), having already penetrated the wall of the diverter sub (41). The actuation shaft may be integrated with the external sealing device (44). Orientation of the diverter sub (41) will be necessary to bring the ball valve socket opposite to the said shaft, or the sealing device can be rotated to align with the ball valve socket. The sealing device (44) can be a pipe ram preventer with a special double seal (45) such that there is formed an annular space (46), which can be filled with mud at full mud pump pressure.

Figure 5:
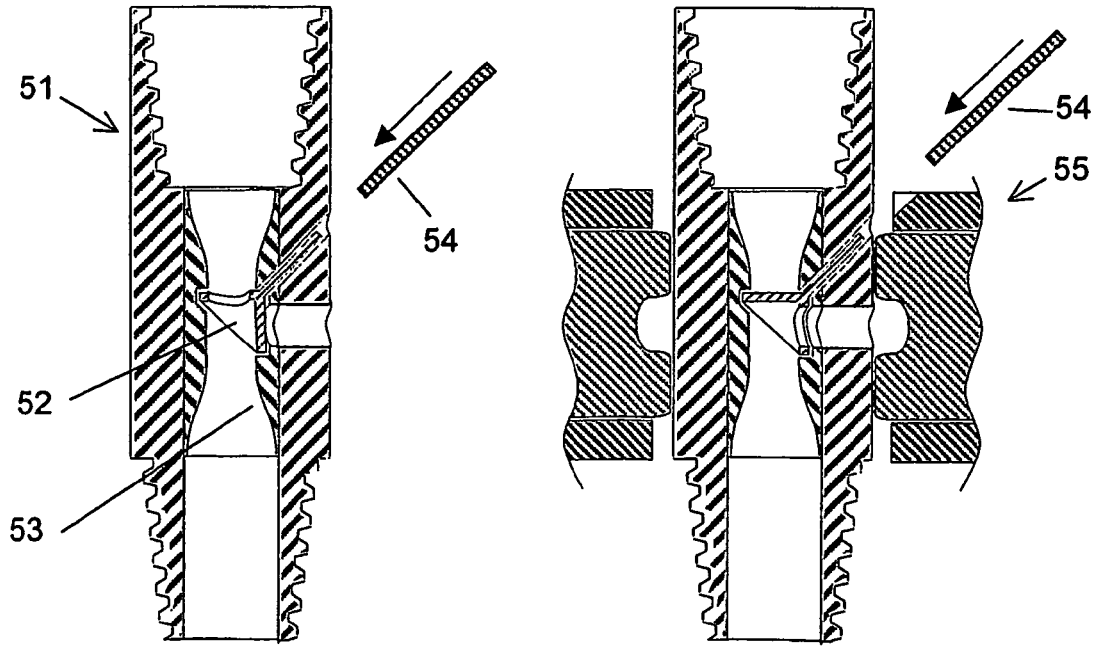
FIG. 5 illustrates the actuation of a new cone valve requiring diagonal shaft access.

Referring to FIG. 5, the new cone valve (52) shown may more economically use the space to facilitate a larger internal diameter within the limited external body of the diverter sub (51). The cone valve having a near perfect smooth internal cylindrical surface when allowing axial flow, within a narrowing bore, having a venturi shape (53) to minimise dynamic (or friction) pressure drop. The shaft (54) to rotate the cone valve may exit the diverter sub (51) at an angle to the vertical, such that it may avoid having to penetrate the sealing device (55).

Figure 6:
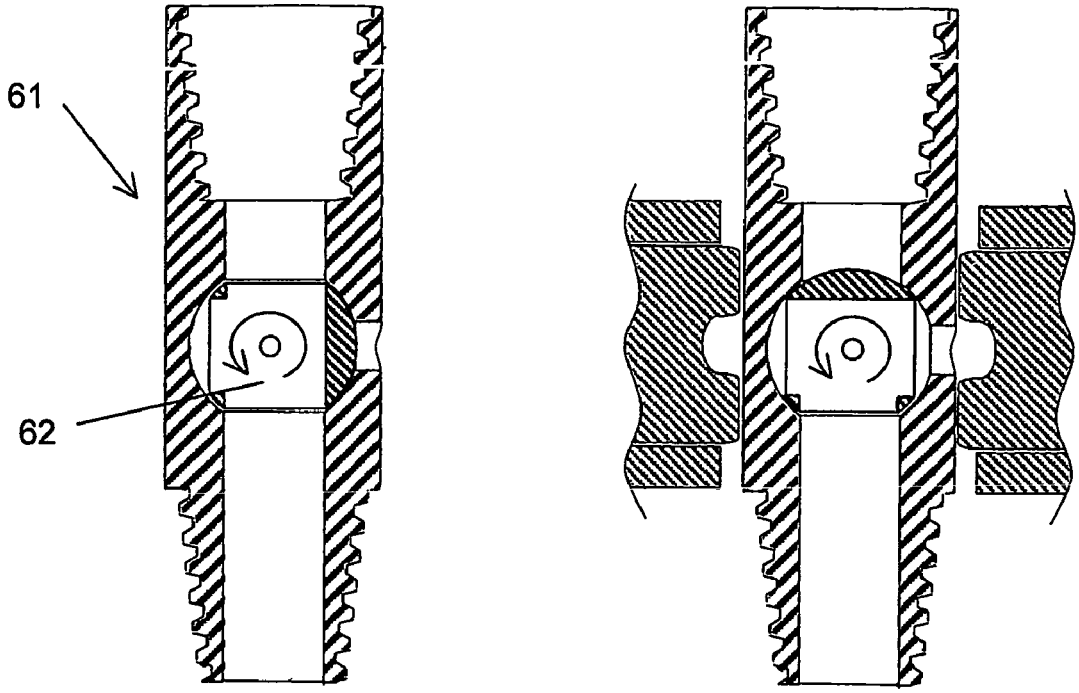
FIG. 6 illustrates the possibility of achieving full bore access using a ball valve.

FIG. 6 illustrates an ideal integration of ball valve (62) and diverter sub (61) to use the thick walled diverter sub to maximum advantage; state of the art fabrication and assembly methods for down hole components will facilitate this fabrication. Where full bore axial flow is required, the use of ball valve, as shown in FIGS. 1 and 6, is restricted to diverter subs where the wall thickness is significantly greater than 25% of the internal diameter; generally, the diverter sub will conform to the wall thickness and internal diameter of the tool joint, and so, for many applications, the wall thickness will be inadequate to accommodate a ball valve. A lesser wall thickness is required for the new cone valve design in FIG. 7 and an even smaller wall thickness is required for the new valve designs shown in FIGS. 11, 12 and 13.

Figure 7:
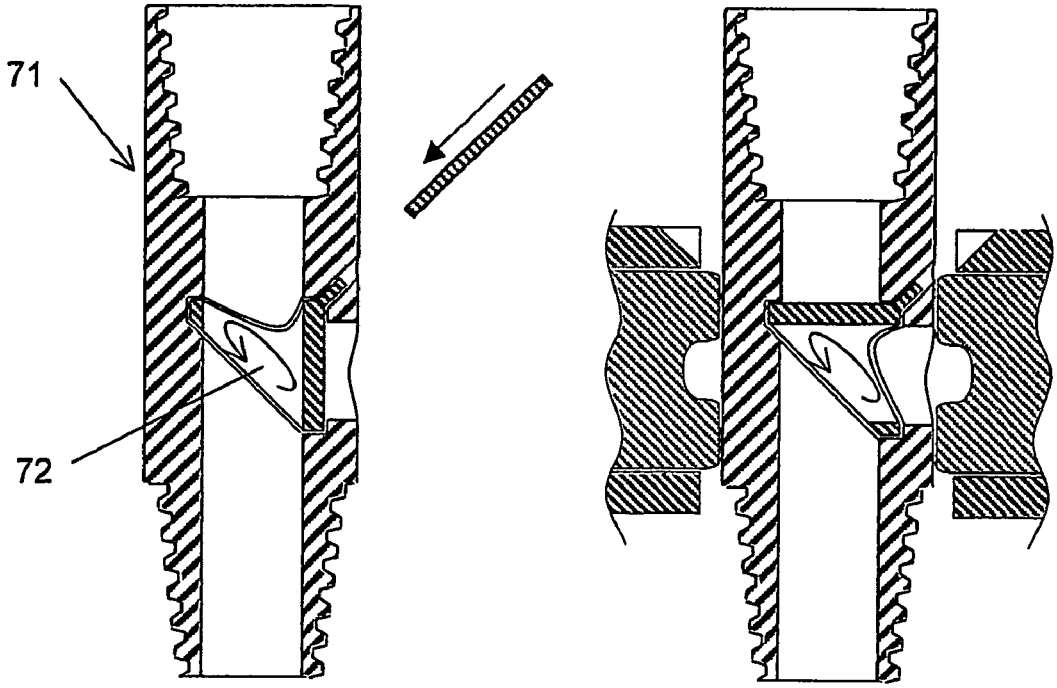
FIG. 7 illustrates the possibility of achieving full bore access using a cone valve.

FIG. 7 illustrates the ideal application of the cone valve (72). The width of the cone across the diverter sub is wider in the direction perpendicular to the drawing and the sealing surface is conical in both the axial flow and mud port directions but the design is still more economical on space than the ball valve.

Figure 8:
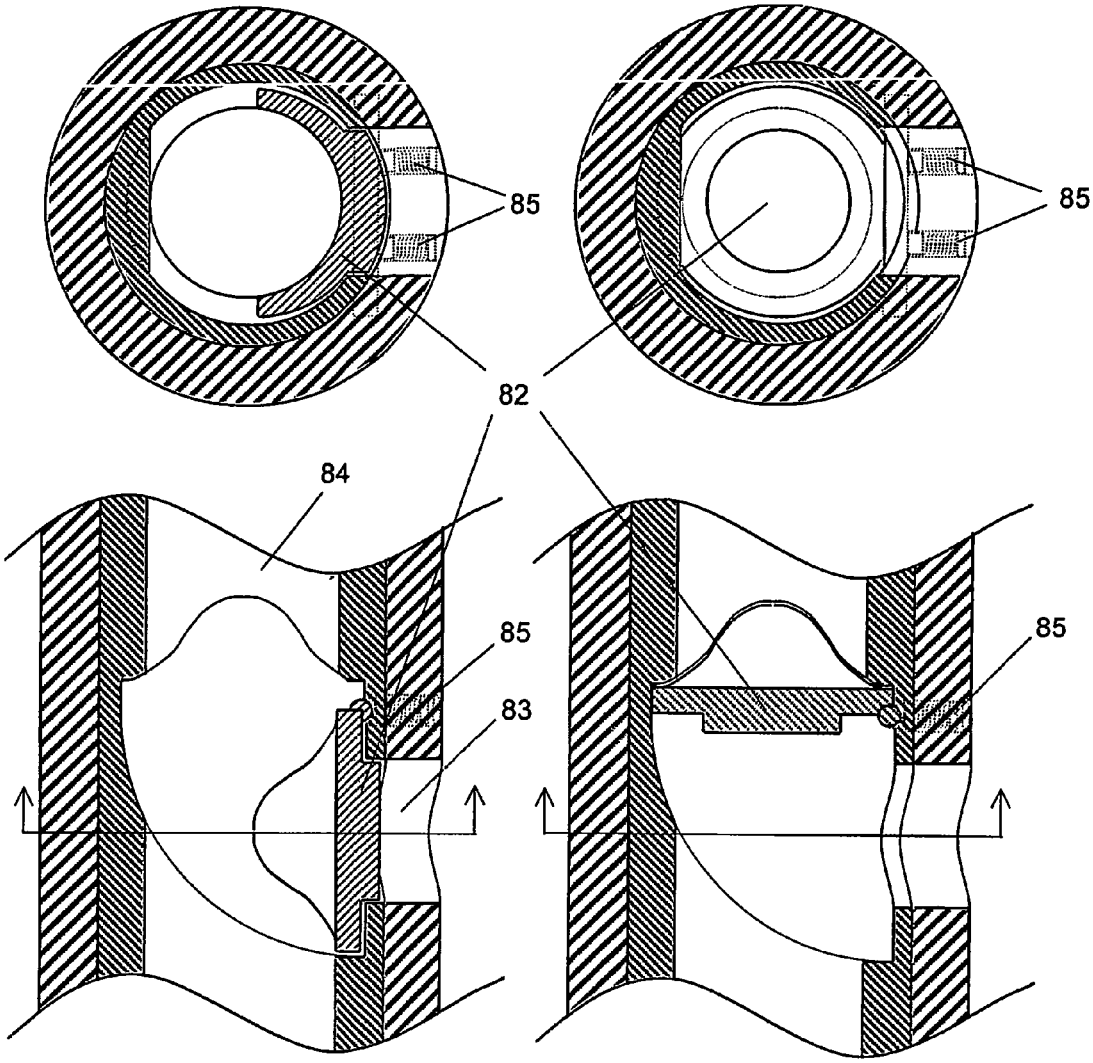
FIG. 8 shows a flapper valve useful in the invention.

FIG. 8 illustrates a new type of flapper valve (82), which provides a full bore aperture during axial flow. This does not require mechanical actuation but responds to the predominant pressure and flow. When the pressure at (83) exceeds the pressure at (84) the flapper valve opens the mud port at (83) to allow inward flow. If the pressure at (84) is reduced further, the flapper valve (82) closes off the axial flow entirely. Springs (85) may be added to increase positive closure in either or both directions.

Figure 9:
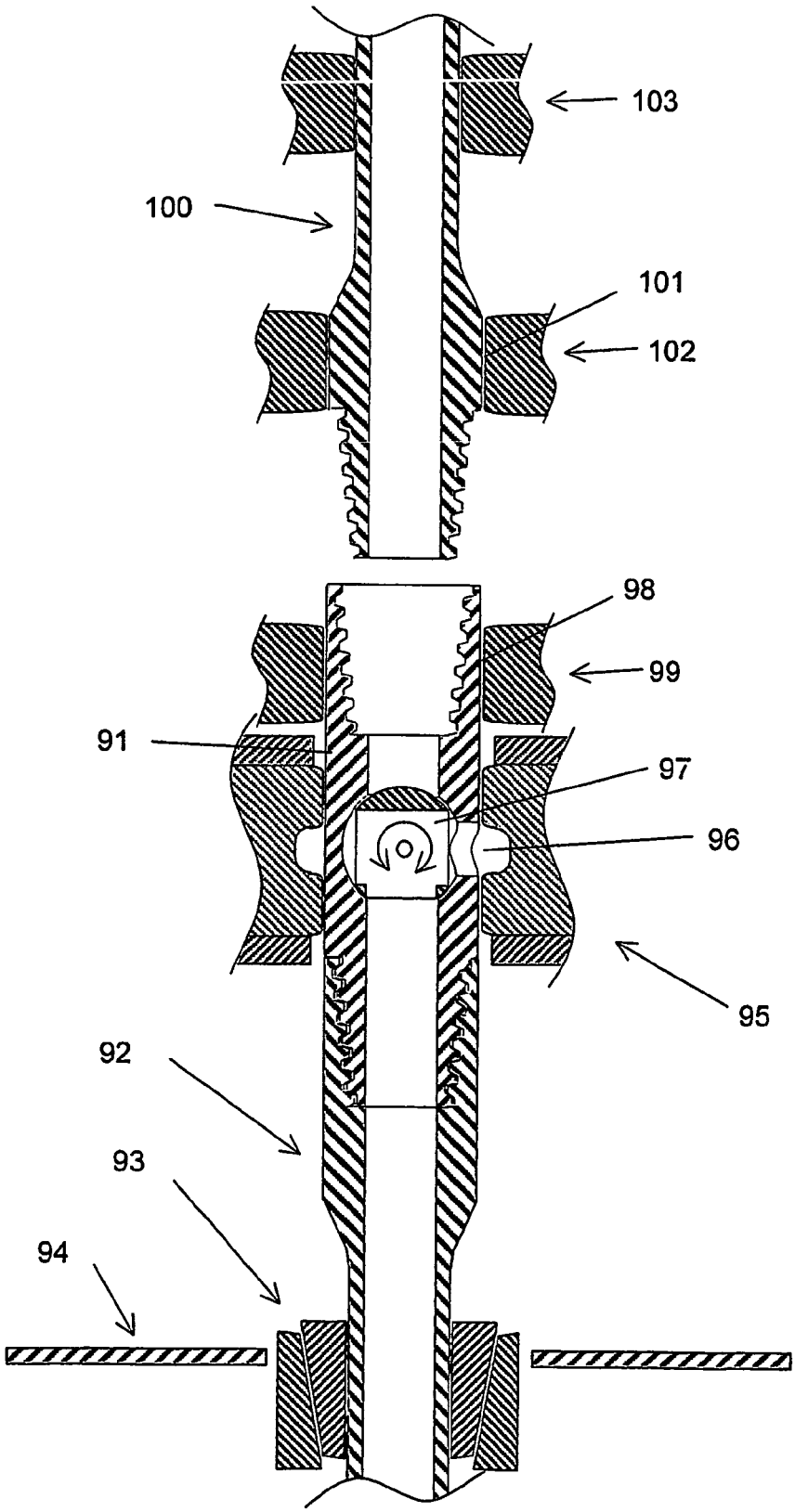
FIG. 9 shows options for the external sealing unit, as a standard ram preventer with double seals or a more mobile clamping unit, which splits for removal when not required.

FIG. 9 shows a diverter sub (91) in use in a drilling rig. In use, the diverter sub (91) is connected and locked to, or integral with, the drill string (92), which is shown supported in the slips (93) in the centre of the drill floor (94). A sealing device (95) seals around the diverter sub mud port (96), so that, when the diverter sub flow is diverted (97) the flow of mud to the drill string can be supplied via the mud port (96). With the mud diverted, the tool joint box (98) can be gripped by lower tongs or lower jaws of an iron roughneck (99) and the Top Drive sub or tubular above (100) can be disconnected by upper tongs or upper jaws of an iron roughneck (102) gripping the pin upset (101). The tool joint connections can thereby be made conventionally above the diverter sub and sealing device, with or without an iron roughneck. The diverter sub (91) increases the height of a stand of drill pipe by less than about 2 ft. and the sealing device (95) is small enough to be accommodated on most rig floors and its structure and operation can be integrated with that of an iron roughneck.

Figure 10:
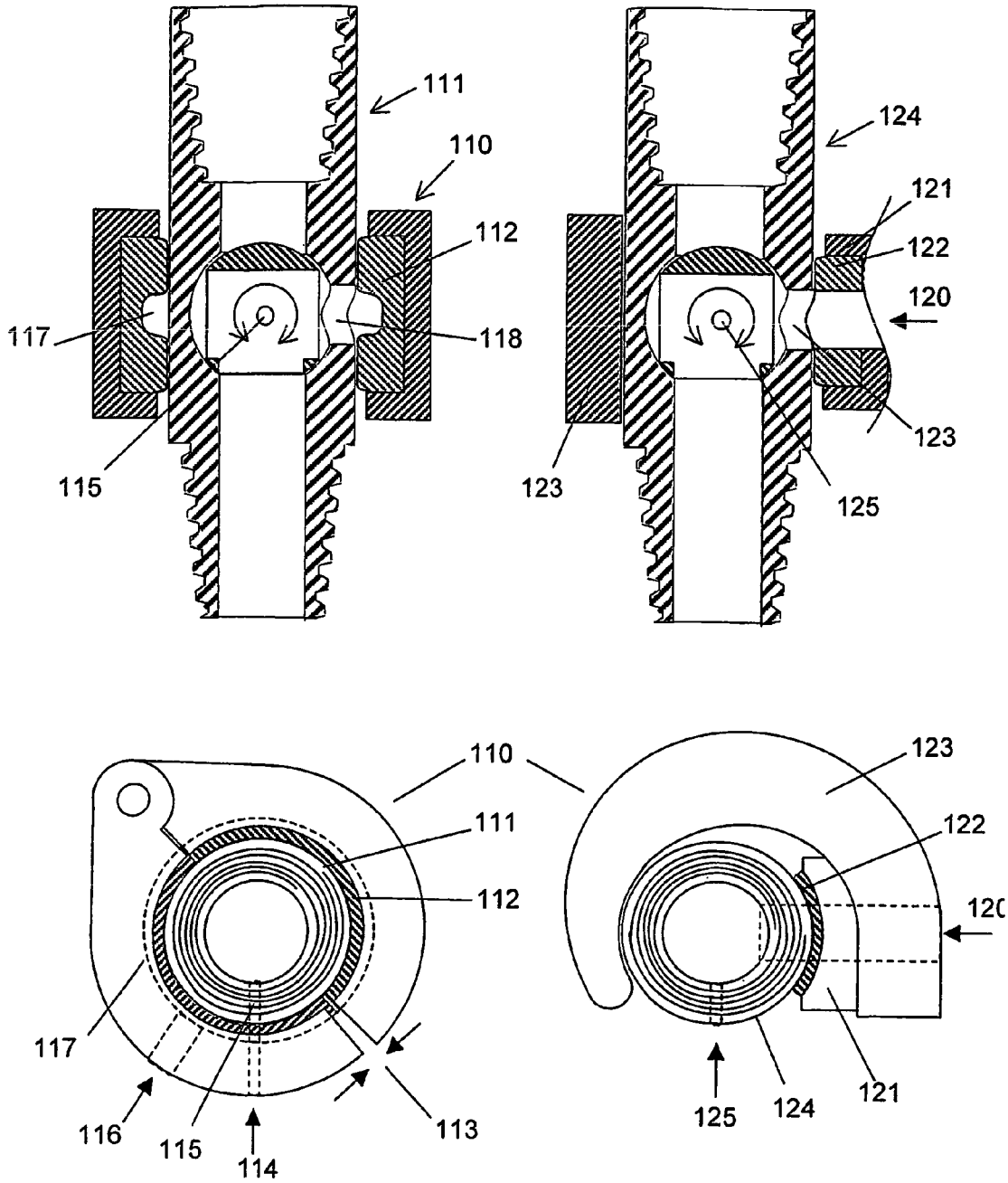
FIG. 10 shows options for the internal valve units to preserve full bore passage through the diverter sub, for passing wireline tools.

FIG. 10 shows two options for the design of the sealing device, where, instead of using a standard pipe ram preventer, as described previously, a hinged clamp (110) may be secured around the diverter sub (111) forcing the sealing element (112) against the diverter sub, by mechanically or hydraulically closing the clamp at (113) with the actuation shaft (114) of the diverter sub valve passing through the clamp at (113) to engage and rotate the socket (115) of the said ball valve. The mud can be supplied at (116) into the annular space (117) around the diverter sub and into the mud port at (118). This allows the mud port to receive mud regardless of its azimuth orientation but the clamping force is significant. Alternatively the clamp may be an open jaw structure, wherein the structural component (121) carrying the sealing element (122) is mechanically or hydraulically forced out of the structure (123) and against the side of the diverter sub (124) and the sealing element (122) seals directly around the mud port (120). This requires a lower clamping force and leaves the diverter sub ball valve socket (125) easily accessible for actuating.

Figure 11:
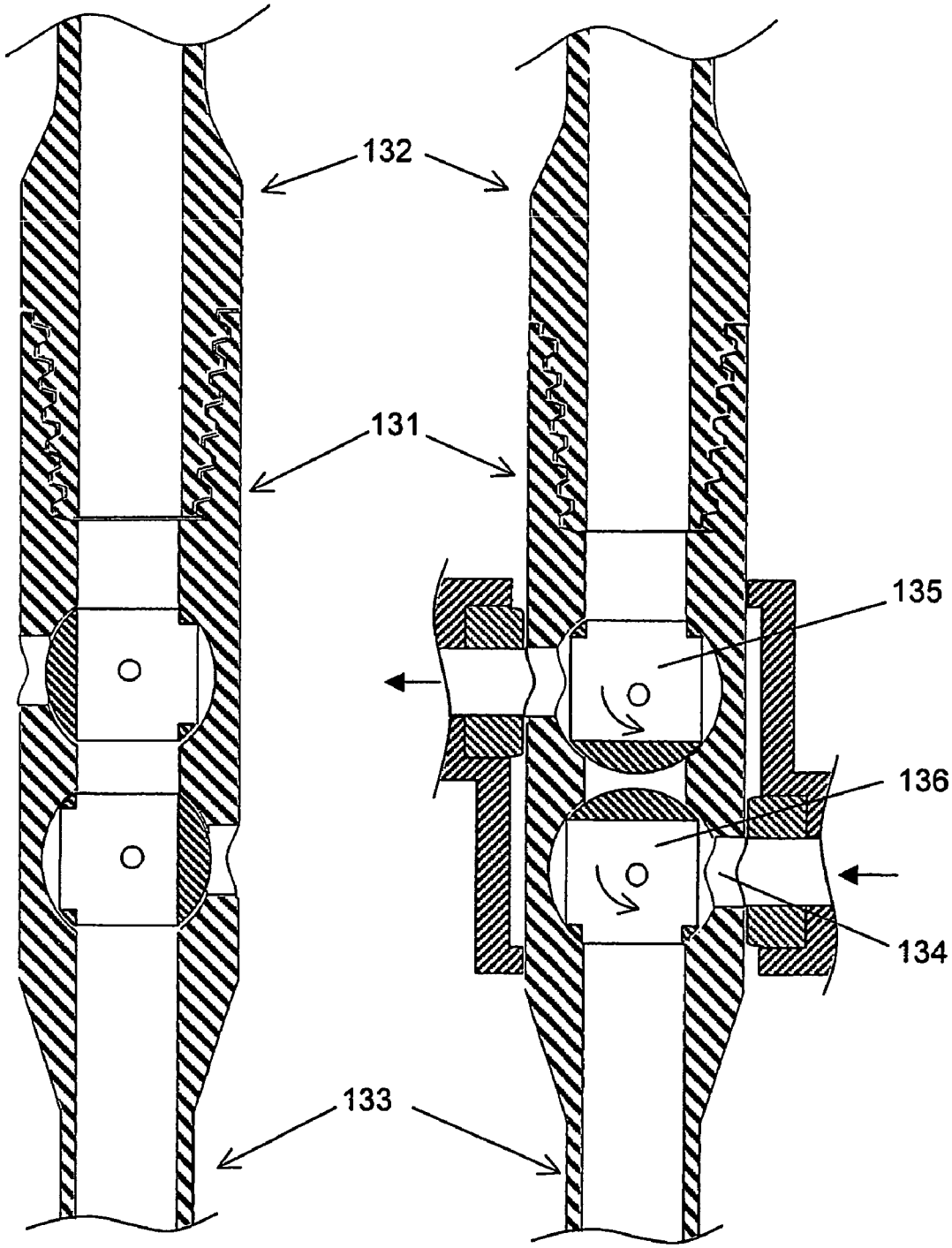
FIG. 11 shows options for double valving to facilitate draining or flushing of the tubulars above the diverter sub, before tool joint connections and/or after tool joint disconnections.

FIG. 11 shows a design for a double valve diverter sub (131), integrated into the tool joint box (132) of the top joint of the drill string (133). While drilling, the diverter sub valves (135) and (136) are open to axial flow at full bore, to allow passage of wireline tools. Before disconnecting the Top Drive sub, or other tubular above (132), both valves are rotated; firstly the lower valve (136) is rotated to allow mud to flow down the drill string (133) from the mud port (134) and then the mud supply to the Top Drive is closed and the upper valve (135) is opened to drain the Top Drive sub or tubular above (132) before disconnecting it.

Figure 12:
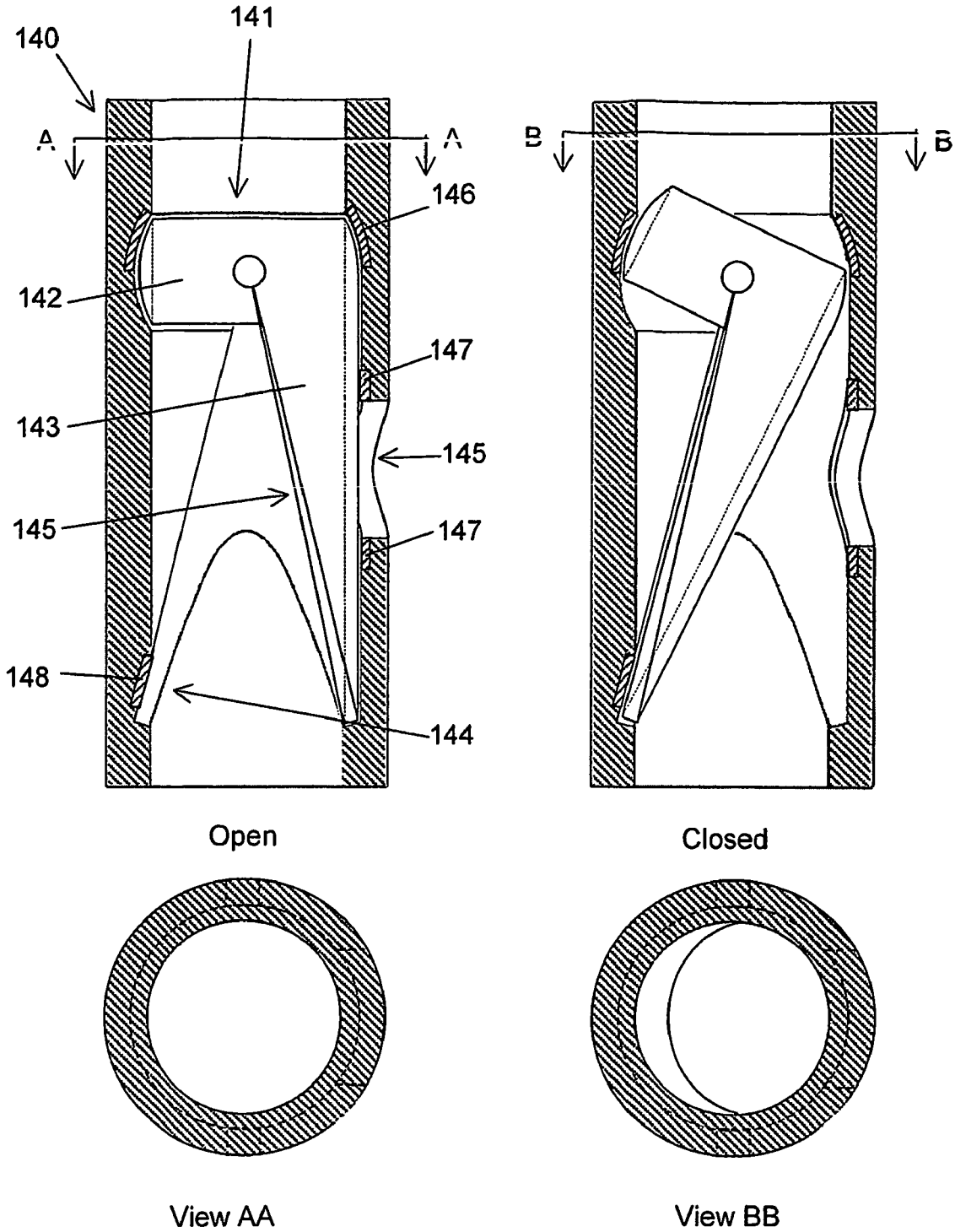
FIG. 12 shows a combination of 'ball' and 'flapper' designs that allows full bore axial flow but does not require the wall thickness that a ball valve requires.

FIG. 12 shows a new diverter valve design (141), suitable for the diverter sub (140), in the open and closed positions. The design combines the functions and benefits of the ball and flapper types of valve, in which the upper part (142) operates like a ball valve and the lower part (143) acts like a flapper valve or one half of a butterfly valve. Since the valve (141) needs only to rotate a small amount, considerably less than 90°, to operate fully, the upper part (142) needs only to be a slice of a conventional ball valve. Additionally, because the lower part (143) conforms in shape to a section of a cylinder, it fits into the wall of the diverter sub (140), when open to allow full bore axial passage. When in the closed position the lower part (143) seals against a ledge (144) cut away in the internal wall of the diverter sub (140), the sealing surface (148) of the lower part being a section of an ellipse or similar figure in overall shape. The side mud port (145) opens before the diverter valve inlet closes thus overlapping the supply of mud to the drill string. The seals at (146), (147) and (148) being any state of the art sealing surface, such as metal to metal, chevron seal or 'o' ring, capable of withstanding a pressure differential of up to 5,000 psi or more.

Figure 13:
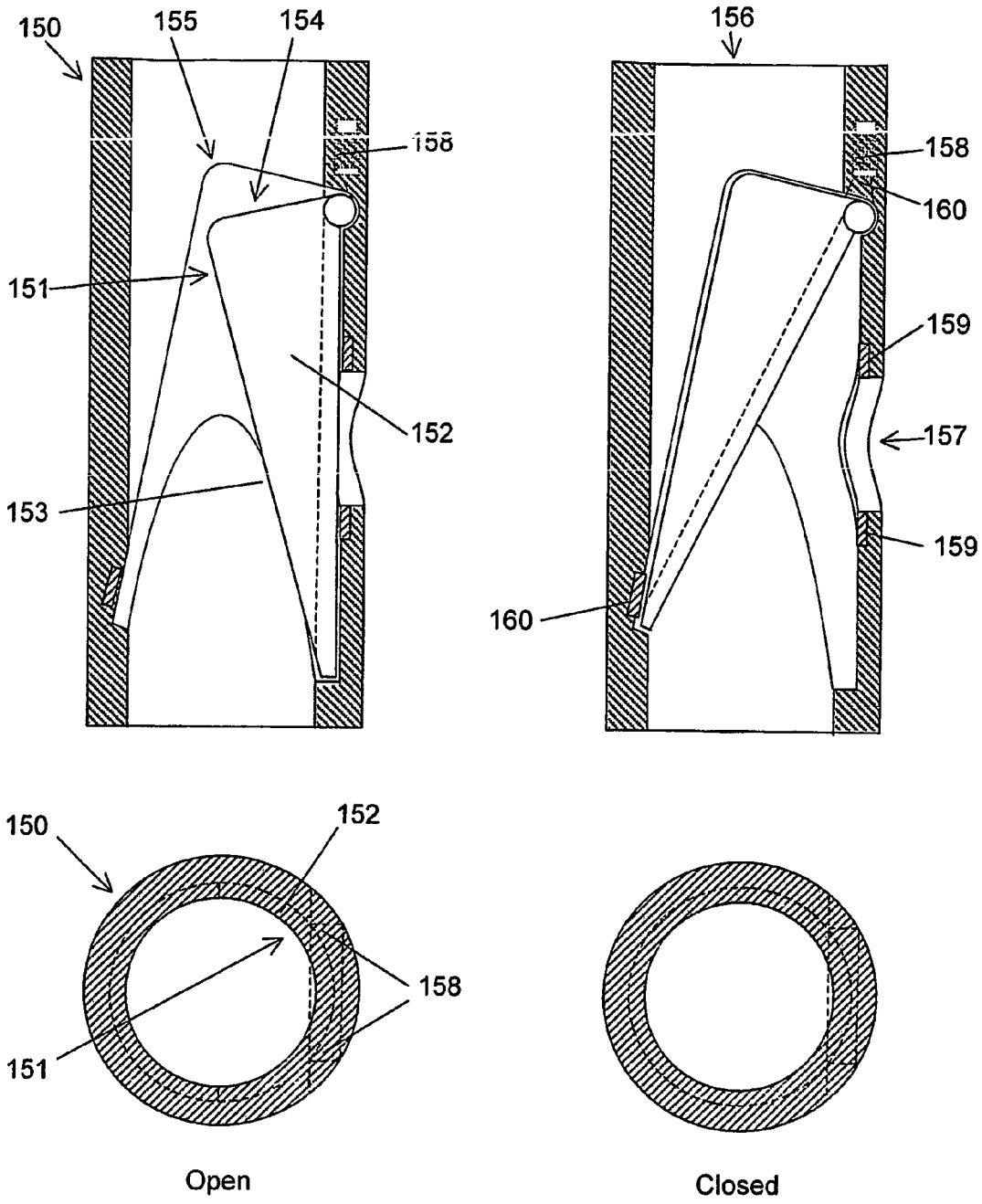
FIG. 13 shows a 'flapper' type of valve that allows full bore axial flow and arguably requires the minimum possible wall thickness.

FIG. 13 shows a new type of flapper valve (151) suitable for use in a diverter sub (150) in which the valve blade (152) is formed entirely from a section of cylinder, which ensures that, in the open position, this valve blade takes up the minimum possible wall thickness. The shape of the sealing surface of the blade in the closed position, approximates to sections of two ellipses (153) and (154), which, when the flapper valve is closed, seal against a ledge (155) cut into the body of the diverter sub (150). In operation, the flows from the inlet (156) and the mud port (157) overlap, as the valve blade moves between the open and closed positions shown. The valve may be assisted in its final closing and/or opening by the addition of a spring or springs at (158). The seals at (159) and (160) being any state of the art sealing surface, such as metal to metal, chevron seal or 'o' ring, capable of withstanding a pressure differential of up to 5,000 psi or more.

Figure 14:
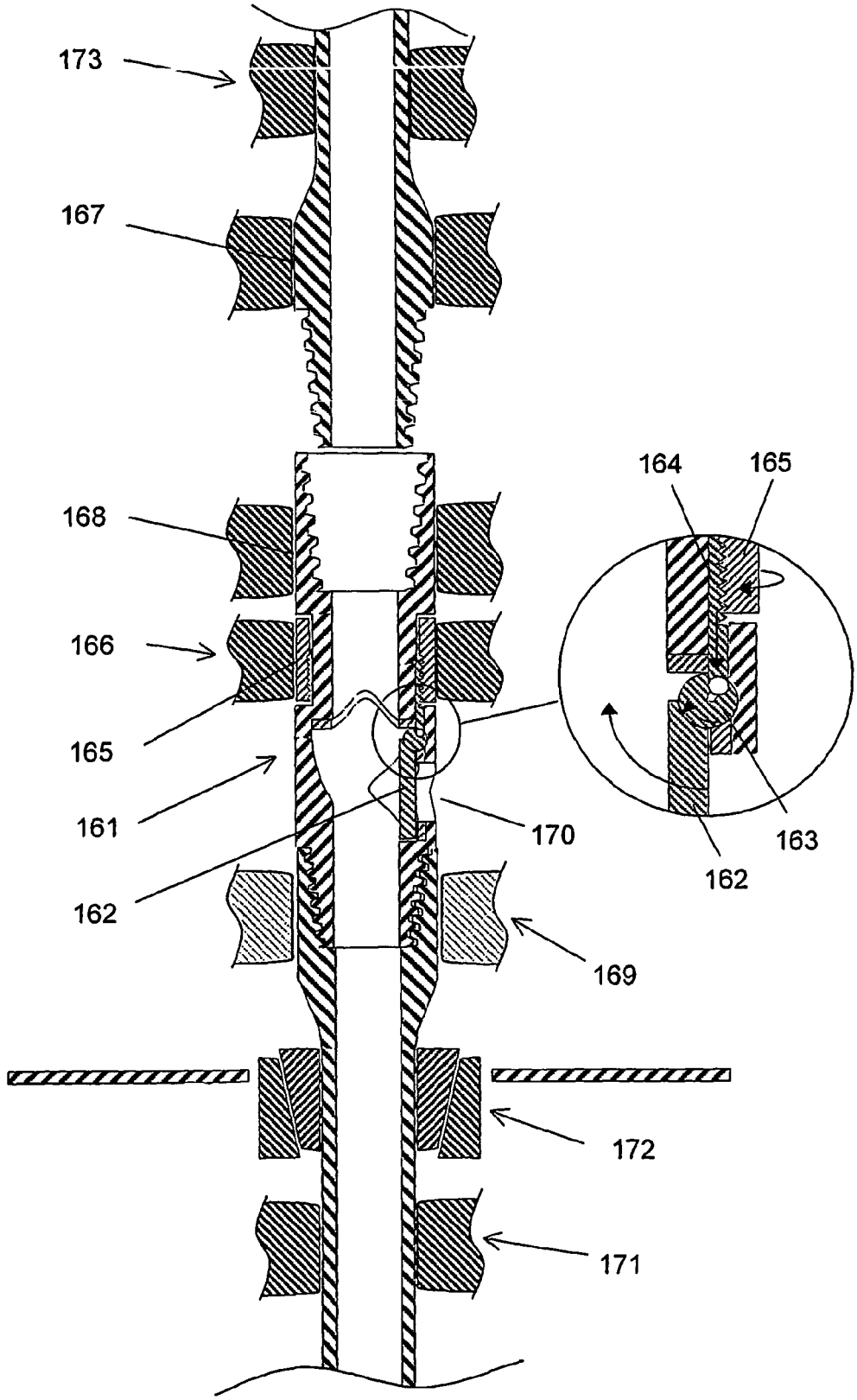
FIG. 14 shows the application of the diverter sub in a situation where continuous rotation was required as well as continuous circulation.

FIG. 14 shows one method of using the diverter sub (161) in such a way that continuous rotation as well as continuous circulation could be achieved. The blade (162) of the diverter valve is shown in the open position; it is opened and closed positively by the action of the axle (163) being turned through 90° by the connecting rod (164) which is raised and lowered by a screw thread within the cylindrical collar (165). As the cylindrical collar (165) is gripped by jaws at (166), it can be made to rotate about the body of the diverter sub (161) and thereby screw the connecting rod (164) up and down. In use the cylindrical collar (165) would rotate clockwise (looking downwards) to open the side mud port and close the axial flow and so it would not inadvertently do so during normal drilling, which normally involves clockwise rotation of the drill string. In addition to this positive action, the method allows for the making and breaking of tool joint connections by gripping and rotating the pin (167) and box (168) at different speeds. The jaws (166) need only apply a nominal pressure, enough to turn the cylindrical collar (165) relative to the diverter sub (161) and these jaws are preferably the sealing surfaces of an RBOP (Rotary Blow Out Preventer). Hence a RBOP at (166) may combine with an upside-down RBOP at (169) to provide a pressure hull to convey mud at up to 5,000 psi or more to the mud port (170). Alternatively, the upside down RBOP may be omitted at (169) and a RBOP at (166) may be combined with a conventionally located RBOP at (171) to provide a pressure vessel that contains the mud but has to include the slips unit (172). The relative rotary motion between the pin at (167) and box at (168) can be achieved with rotary 90° grips as has been described in Patent PCT/GB2003/001410. The torquing and untorquing of the tool joint connection may be conveniently achieved by including a differential gear box between the drives to the grippers at (167) and (168). The grips at (173) are conventionally used to spin the pin (167) in or out of the box (168) but may be omitted if rotary grips are used at (167).

Figure 15:
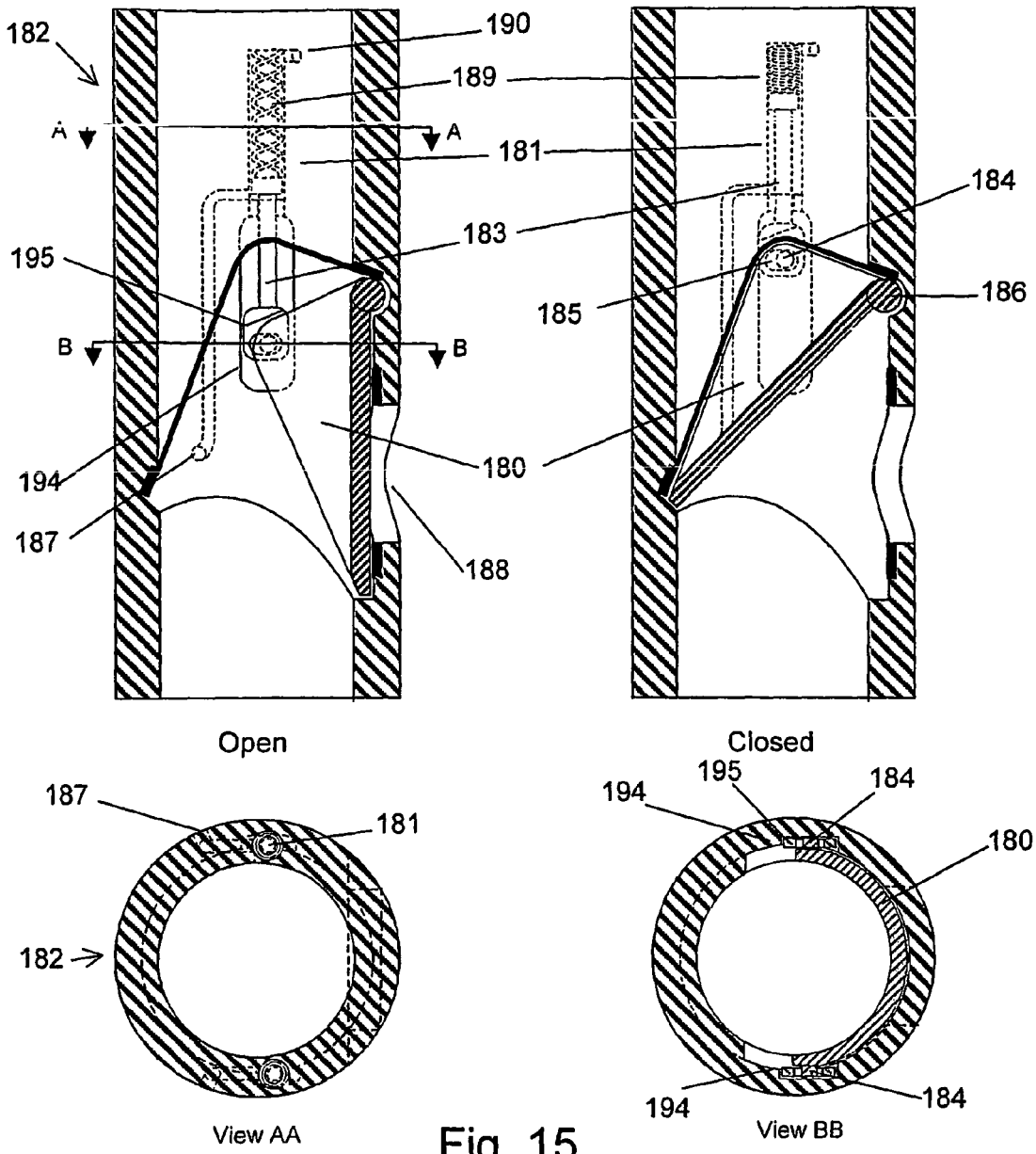
FIG. 15 shows the inclusion of hydraulic cylinders within the thickest section of wall of the diverter sub, providing positive closing and opening, suitable for continuous circulation and rotation.

FIG. 15 shows the valve blade (180), which is shaped to be a section of a cylinder as seen in View BB, being actuated by hydraulic cylinders (181) located in the thickest section of the wall of the Diverter Sub (182). The connection between the piston rod (183) and the blade (180) is via a lug at (184) within a slot (185), such that the lug (184) must move vertically with the piston (183) but may slide sideways in the slot (185) as the blade (180) rotates about its pivot (186). High pressure mud at (188) can be applied at (187) and thereby force the piston upwards against a spring (189), provided that the pressure at (190) is low, such as at atmospheric pressure.

Figure 16:
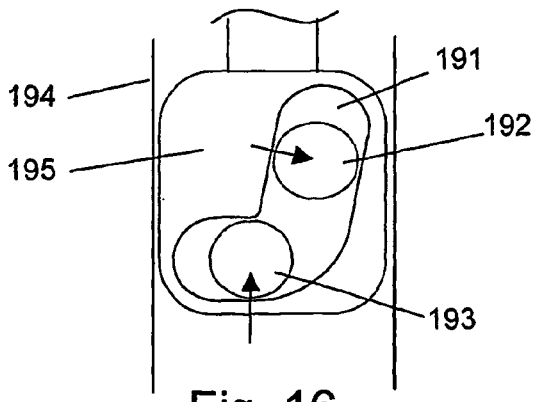
FIG. 16 illustrates one method of wedging the valve open to the axial flow and closed to the side mud port.

FIG. 16 shows how the slot, (185) in FIG. 15, may be altered to (191) in FIG. 16, to provide a wedging action to ensure that, as the slot (191) moves downwards, the lug (192) is pushed in the direction of closing the side mud port (188). When the slot (191) moves upwards, the lug moves to the left as the valve closes and back to position (193) when the valve is closed and the piston (183) transmits force on the lug at (193) in the upwards direction to keep the valve closed. The wedging action of the slot (191) is assisted by the reaction of the diverter sub body at (194) against which the slot unit (195) slides.

The invention claimed is:

1. A valve assembly for use in continuously supplying drilling fluid from a tubular to a drill string comprising:

(a) a valve body having a first inlet passage adapted to be connected to a tubular, and an outlet passage adapted to be connected to a drill string;

(b) said valve body having a second inlet passage, said second inlet passage extending into said valve body at substantially a right angle with respect to that of said first inlet passage and said outlet passage;

(c) high pressure seal means surrounding said second inlet passage;

(d) annular fluid passage means within said seal for flowing drilling fluid from outside said seal into said second inlet passage;

(e) a two position valve positioned in said valve body such as to, in a first position permit flow from said tubular to said drill string while preventing flow from said second inlet passage, and in a second position preventing flow from said tubular to said drill string while permitting flow into said drill string from said second inlet passage; and (f) actuator means for moving said two position valve to and from said first and second positions.

2. The valve assembly of claim 1 wherein said actuator means is positioned outside of said valve body.

3. The valve assembly of claim 1 wherein said actuator means is positioned within said valve body.

4. The valve assembly of claim 1 wherein said valve actuator means are responsive to the differential pressure in said first inlet passage versus the pressure in said second inlet passage.

5. A method for continuously circulating a drilling fluid down a drill string while tubulars are added to said drill string comprising:

(a) mounting a diverter sub containing a valve at the lower end of each of a plurality of tubulars to be joined to a drill string;

(b) moving said valve to a first position which prevents the flow of drilling fluid from the tubular into the drill string while simultaneously allowing the flow of drilling fluid from outside the diverter sub into and down said drill string while joining a tubular to a drill string;

(c) subsequently moving said valve to a second position preventing the flow of drilling fluid from outside the diverter sub while allowing the flow of drilling fluid from said tubular downwardly into said drill string after said joint has been made;

(d) sealing the diverter sub against flow of drilling fluid from outside the diverter sub when said valve is not in said second position; and (e) continuing to rotate the drill string in a bore hole while adding tubulars, and continuing the circulation of drilling fluid down the drill string during such drilling.

6. A diverter sub comprising in combination:

(a) an inlet of a size and shape to be connected to a tubular and an outlet of a size and shape to be connected to a drill string;

(b) side port means in said diverter through which drilling fluid may flow into said sub;

(c) diverter valve means mounted within said sub for movement between first and second positions;

(d) said valve means being positioned in said sub for closing said side port means in said first position while allowing drilling fluid to flow from said tubular to and down said drill string, and a second position for preventing flow from said tubular to said drill string while allowing drilling fluid to flow through said side port means and down said drill string;

(e) sealing means surrounding said side port means, and passage means for flowing drilling fluid through said sealing means to and through said side port means; and (f) said passage means include a flow passage extending at least partially circumferentially about the longitudinal axis of said diverter sub.

7. The diverter sub of claim 6 wherein said sealing means are of such construction, material and configuration such as to maintain a fluid-tight seal against drilling fluid pressures of at least 5,000 psi.

8. The diverter sub as claimed in claim 6 wherein said sealing means comprise first and second seal means, and wherein said first and second seal means are positioned above and below said side port means, respectively.

9. The diverter sub as claimed in claim 6 wherein said sealing means comprise:

(a) an annular seal member surrounding and engaging the external surface of said diverter sub, and;

(b) clamp means surrounding said seal means, and;

(c) means for forcing said clamp means against said seal member for forcing said annular seal member against said external force with a force sufficient to withstand drilling fluid pressures of at lest 5,000 psi.

10. The diverter sub as claimed in claim 6 wherein said seal means surround said side port means and include an annular passage in fluid communication with said side port means, and inlet passage means in fluid communication with said annular passage means for supplying high pressure drilling fluid through said annular passage and said side port means into and down said drill string.

11. The diverter sub as claimed in claim 6 wherein said valve means include a pivot for pivoting said valve means between first and second positions, and wherein said valve means are positioned and are of such structural design as to be forced into said first and second positions by pressure differentials between the drilling fluid in said tubular versus that in said side port means.

12. The diverter sub of claim 6 including lever means for opening and closing said valve means, said lever means extending at an angle to the longitudinal axis of said diverter sub.

13. The diverter sub of claim 6 wherein said diverter sub is integral with one end of said tubular.

14. The diverter sub of claim 6 wherein said valve means comprises two non-return valves one of which will allow drilling fluid to flow from said tubular to and down said drill string whilst the other will allow drilling fluid to flow through a said side port means and down said string.

* * * * *